US005152639A

United States Patent [19]

Visconti

[11] Patent Number: 5,152,639

[45] Date of Patent: Oct. 6, 1992

[54] TUBULAR FOOTING FORM FOR BUILDING FOUNDATION PILES OF CONCRETE

[76] Inventor: Roberto Visconti, Via Dante 33, Piacenza, Italy

[21] Appl. No.: 639,909

[22] Filed: Jan. 10, 1991

[30] Foreign Application Priority Data

Jan. 16, 1990 [IT] Italy ..... 19074 A/90

[51] Int. Cl.[5] ..... E02D 5/56

[52] U.S. Cl. ..... 405/240; 405/233; 405/243; 405/249

[58] Field of Search ..... 405/233, 240, 243, 231, 405/232, 235, 236, 242, 248, 249

[56] References Cited

U.S. PATENT DOCUMENTS

| | | | |
|---|---|---|---|
| 1,089,184 | 3/1914 | Bolen | 405/240 |
| 2,649,694 | 8/1953 | Pickman | 405/240 |
| 4,269,544 | 5/1981 | Rusche | 405/233 X |
| 4,708,529 | 11/1987 | Lindell | 405/240 |

FOREIGN PATENT DOCUMENTS

| | | | |
|---|---|---|---|
| 12961 | 4/1929 | Australia | 405/233 |
| 296168 | 2/1972 | Austria . | |
| 177423 | 10/1984 | Japan | 405/231 |
| 6513545 | 4/1967 | Netherlands | 405/233 |
| 8500630 | 10/1986 | Netherlands | 405/233 |
| 333106 | 11/1958 | Switzerland | 405/233 |
| 389515 | 7/1965 | Switzerland . | |
| 2043755 | 10/1980 | United Kingdom . | |

*Primary Examiner*—Dennis L. Taylor
*Assistant Examiner*—John A. Ricci
*Attorney, Agent, or Firm*—Hedman, Gibson & Costigan

[57] ABSTRACT

A tubular footing form of the recoverable type for building concrete foundation piles comprises an end shutting organ destined to prevent water from the water bed from entering the footing form while the latter is being plunged into the ground and to enable the concrete casting to be performed during the step of recovery of the same footing form. The end shutting organ is installed inside the tubular footing form at a certain distance from its free end so as to create a seal chamber which, during the step of plunging of the footing form, gets filled with compacted earth, which forms a plug which tightly seals the shutting organ against the entering of water from the water bed.

4 Claims, 3 Drawing Sheets

TUBULAR FOOTING FORM FOR BUILDING FOUNDATION PILES OF CONCRETE

Figure 2:
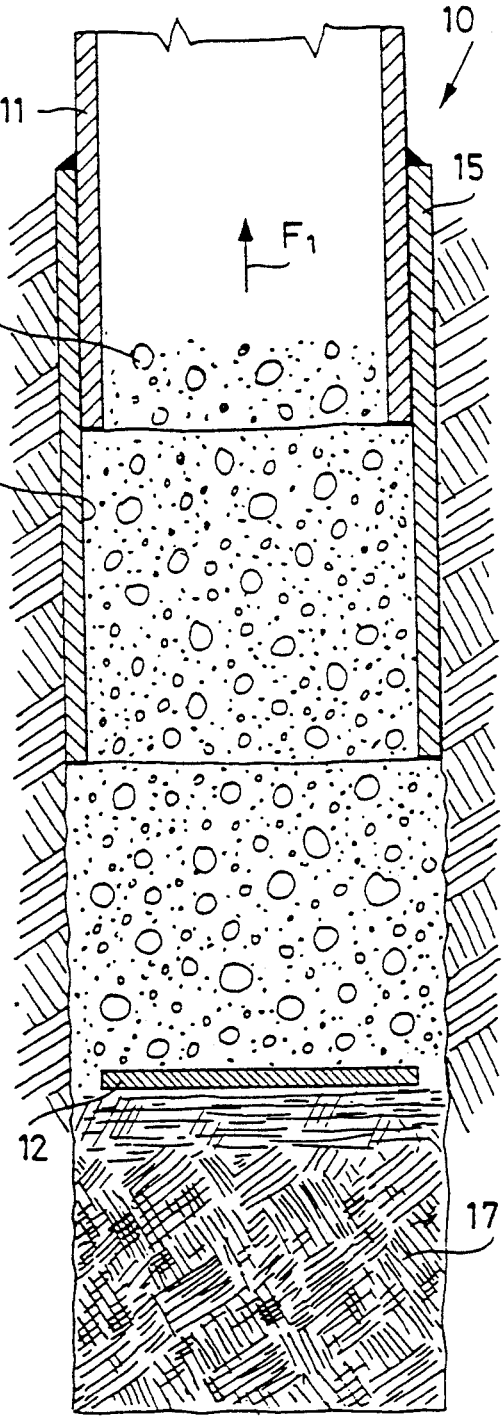

The present invention relates to a metal tubular footing form for building foundation piles of concrete, equipped with an end shutting organ installed inside its tubular interior, and capable of generating a simple and perfectly tight seal against water from water bed.

As those skilled in the art are well aware of, when such concrete foundation piles are built, a recoverable footing form is preferably used in lieu of an expendable one, above all owing to cost reasons.

However, the use of a recoverable footing form requires an adequate solution of the serious technical problem relating to water from water bed entering the interior of said footing form, during the plunging operation.

It should be observed that water from water bed, entering the interior of the footing form, washes away the concrete, with a consequent considerable loss in mechanical strength.

In order to overcome the problem of the presence of water from water bed, the designers adopt often piles of plunged type with expendable footing form, which of course are very expensive; or prefabricated concrete piles, which anyway are brittle and do not withstand the high plunging stresses, for instance when compact ground layers have to be crossed. Furthermore, in a same building yard, the lengths of the individual piles may often by very different from one another, owing to the heterogeneous nature of ground: such a matter of fact involves either a stringent, and therefore expensive planning of the prefabricated lengths, or considerable wastes, with consequent economic damages.

Therefore, the wish is evident of being capable of adopting, as extensively as possible, piles built inside recoverable footing forms—also said tubular formworks.

Heretofore, the task of preventing water from water bed from entering the interior of a footing form of recoverable type was committed to the same end shutting organ thereof, which should also prevent the components of the surrounding ground from entering the formwork during the plunging operation.

Unfortunately, practical tests showed that such a shutting organ, whether it be an expendable tip, or an articulated tip, or whatever else equivalent means, is not absolutely capable of securing an adequate tight seal against water from water bed entering the interior of the formwork; this, owing to the need that such a shutting organ is a mobile part, and/or separable from the bottom end of the footing form, with which it defines undesired clearances.

Furthermore, in order to be capable of withstanding the burdensome stresses to be encountered during the plunging, such a shutting organ should comply with precise dimensional requirements as to its components, which increase the above said problem of the clearances, which is in contrast with the need of accomplishing a perfectly tight seal, above all against water.

Furthermore, those skilled in the art are well aware of the fact that the more extensively the tubular formwork has to be plunged through compact ground layers, the longer the plunging time, and the larger the amount of water entering said tubular formwork.

The purpose of the present invention is of proposing a tubular formwork of recoverable type for building concrete foundation piles which, while secures a perfect tightness against water from water bed entering the interior thereof, is extremely cheap to be manufactured and used.

For that purpose the Applicant thought, according to the invention, of providing a tubular footing form for building concrete foundation piles, which is of recoverable type and comprises an end shutting organ, which is destined to prevent water from water bed from entering the interior of the footing form while said footing form is being plunged into the ground and to enable the concrete casting to be performed during the step of recovery of the same footing form, characterized in that said end shutting organ is installed inside the interior of the tubular footing form at a certain distance from its free end so as to create a seal chamber which, during the step of plunging of the footing form, gets filled with compacted earth forming a plug which tightly seals the shutting organ against the entering of water from the water bed.

Said end shutting organ is preferably installed inside the interior of said tubular form by means of the application of a sleeve to the end of the same footing form.

The structural characteristics and the functional features of the present invention and its advantages over the prior art will be still more clearly understood from the following discussion, referred to the hereto attached schematic drawings, which show examples of tubular footing forms made according to the principles of the same invention.

Figure 1:
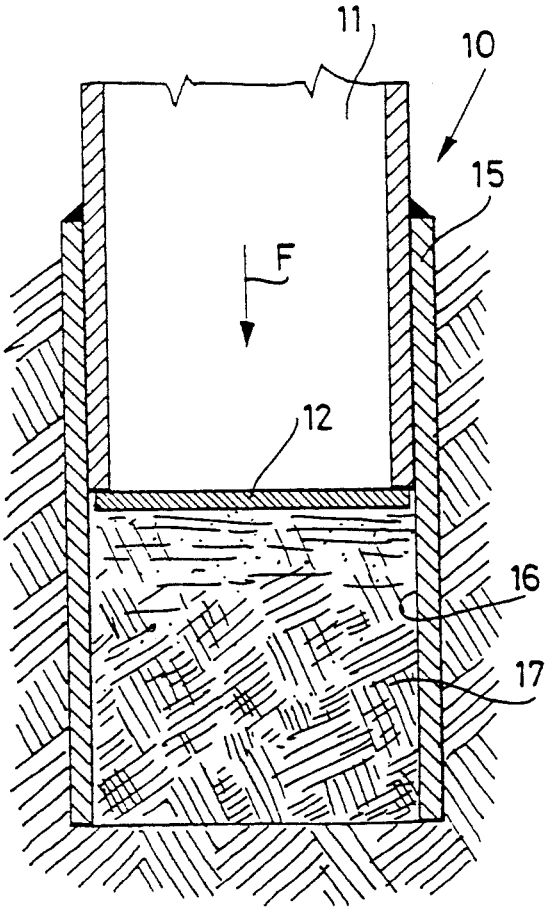
Figure 4:
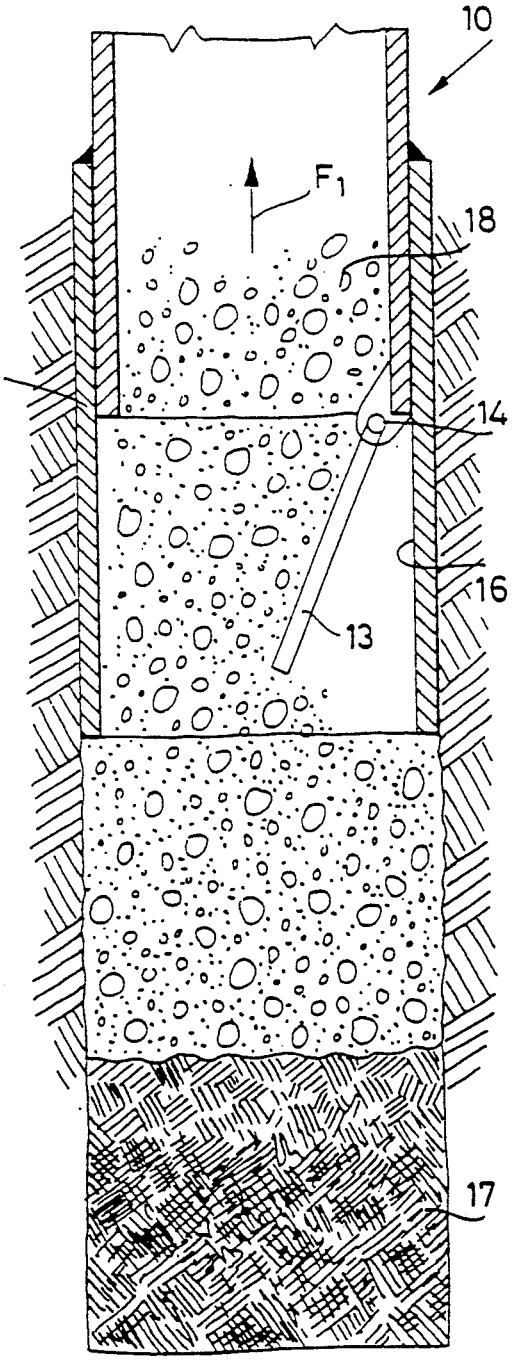
Figure 3:
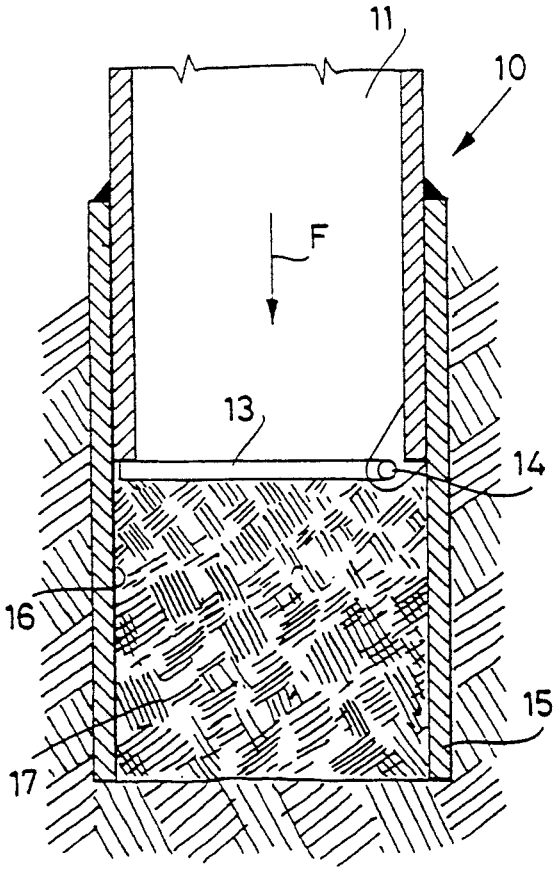
Figure 5:
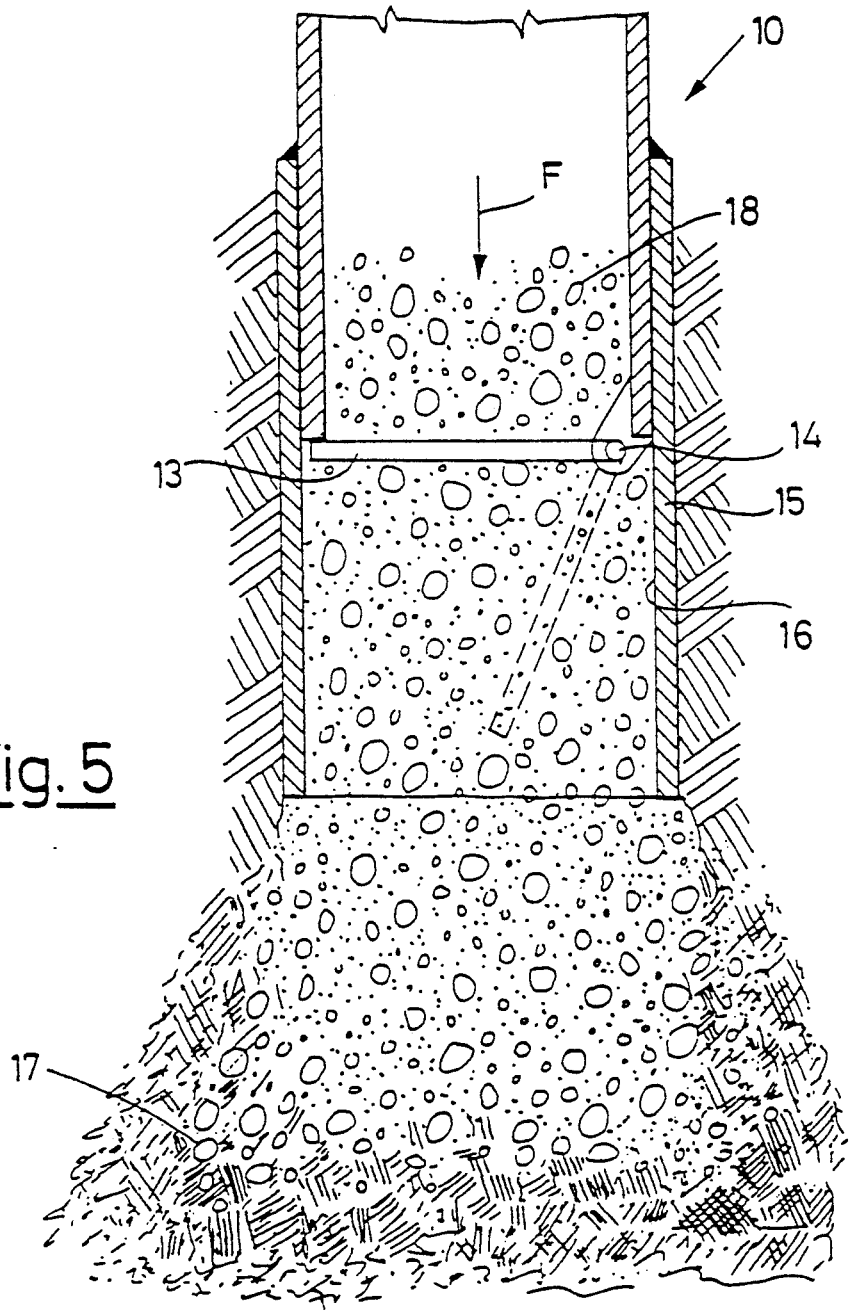

In the drawings:

FIGS. 1 and 2 show the structure and the operating steps of a first example of footing form according to the invention; and FIGS 3, 4 and 5 show the structure and the operating steps of a second example of footing form according to the present invention.

Referring to the drawings, a tubular footing form for casting foundation piles, generally indicated with the reference numeral 10 and accomplished according to the present invention, comprises a tubular body 11 which is provided at its bottom end with a shutting organ, which performs the task of preventing water from water bed from penetrating the footing form while this latter is being plunged into the ground, and to make it possible the concrete casting to be performed during the step of recovery of said footing form.

Said shutting organ can be of a whatever type, all of such types being well-known to those skilled in the art.

In FIGS. 1 and 2 of the hereto attached drawings, the shutting organ is constituted by a metal diaphragm 12 of expendable type, whilst in FIGS. 3-5 of the hereto attached drawings, a door 13 hinged in 14 to the footing form is provided.

Of course, as above said, the diaphragm 12 and the door 13 are indicated herein for merely exemplifying, non-limitative purposes, in that the inventive concept which is explained in the following can be applied to any types of shutting organs.

According to the present invention, and as clearly shown in the drawings, the shutting organ 12-13 is installed inside the tubular footing form 10 at a certain distance from the free end of the latter.

For that purpose, to the tubular body 11 a sleeve 15 is applied, which defines, downstream the shutting 12-13, a seal chamber 16.

The footing form according to the present invention operates as follows.

For example, the footing form 10 is connected at its upper end with vibrating plunging means and lifting means, and is vertically positioned on the site wherein the foundation pile has to be built.

In a known way, e.g., by means of the action of vibrating means, the footing form is plunged into the ground (FIGS. 1 and 3), in the direction of the arrow F.

One can clearly see that during such a plunging operation, the seal chamber 16 gets filled with earth which is more and more compacted, until it will form a sealing plug 17, which tightly seals the shutting organ 12–13, thus preventing water from water bed and fine particles and sand from entering the lower portion of the footing form.

When the plunging step is over, the footing form 10 is disconnected from the above cited lifting means, in order to enable it to be filled with concrete 18 fed, e.g., by a concrete mixer through a discharge chute.

When the filling with concrete has taken place, the footing form 10 is hooked again to the lifting means in order to be extracted from ground in the direction of arrow F1 (FIGS. 2 and 4).

Following such an extraction, the only weight of filled concrete causes the opening of the shutting organ 12–13 and, in cooperation with vibrations possibly applied to the tubular framework, the expulsion of the sealing plug 17 from the chamber 16, so that concrete goes to occupy the room by now left free by the tubular body 11 of the footing form 10, thus forming the foundation pile.

If necessary, inside the footing form 10 the metal reinforcements can be laid, which contribute to withstand the various possible bending and shearing stresses.

The extraction of the footing form from ground can be alternated to plunging movements in the direction of arrow F (FIG. 5), such as to further compact concrete, by disgregating and breaking down the sealing plug 17.

In that way, the purpose mentioned at the preamble of the discussion is achieved in a simple and cheap way.

Whilst into the interior of a footing form of a type known from the prior art not only water enters, but an amount of water enters, which is directly proportional to the plunging time or to the time of passage though compact ground layers, the impermeability of the footing form according to the present invention is total, and even increases with increasing plunging times, in that the earth inside the seal chamber gets more and more compact.

I claim:

1. A tubular footing form for building concrete foundation piles, which is of a recoverable type said recoverable tubular footing form comprising an end shutting organ which prevents water from a water bed from entering the interior of the recoverable footing form while said recoverable footing form is being performed during the step of recovery of said recoverable footing form, wherein said end shutting organ is installed inside the interior of the recoverable tubular footing form at a certain distance from its free end so as to create a seal chamber which, during the step of plunging of the recoverable footing form gets filled with compacted earth thereby forming a plug which tightly seals the shutting organ against the entry of water from the water bed and wherein said shutting organ comprises a means for opening during the step of recovery of said tubular footing form.

2. A recoverable tubular footing form according to claim 1, wherein said end shutting organ is installed inside the interior of said recoverable tubular form as a sleeve at the end of said recoverable footing form.

3. A recoverable tubular footing form as defined in claim 1 wherein the means for opening in said shutting organ comprises an expendable metal diaphragm.

4. A recoverable tubular footing form as defined in claim 1 wherein the means for opening in said shutting organ comprises a door hinged to said footing form.

* * * * *